US011505881B2

(12) United States Patent
Schnabel et al.

(10) Patent No.: US 11,505,881 B2
(45) Date of Patent: Nov. 22, 2022

(54) WEAVING LOOM FOR IMPLEMENTING A METHOD FOR WEAVING A FABRIC AND NEAR-NET SHAPE FABRIC MADE ON SUCH A WEAVING LOOM

(71) Applicant: STAUBLI BAYREUTH GMBH, Bayreuth (DE)

(72) Inventors: Andreas Schnabel, Bayreuth (DE); Karsten Siebert, Weidenberg (DE); Jens Ignatzy, Bayreuth (DE)

(73) Assignee: STAUBLI BAYREUTH GMBH, Bayreuth (DE)

( * ) Notice: Subject to any disclaimer, the term of this patent is extended or adjusted under 35 U.S.C. 154(b) by 651 days.

(21) Appl. No.: 16/364,675

(22) Filed: Mar. 26, 2019

(65) Prior Publication Data

US 2019/0264352 A1 Aug. 29, 2019

Related U.S. Application Data

(63) Continuation of application No. 15/216,079, filed on Jul. 21, 2016, now Pat. No. 10,294,589.

(30) Foreign Application Priority Data

Jul. 23, 2015 (EP) ..... 15178073

(51) Int. Cl.
*D03D 13/00* (2006.01)
*D03C 7/06* (2006.01)
(Continued)

(52) U.S. Cl.
CPC ..... *D03D 13/00* (2013.01); *D03C 7/06* (2013.01); *D03C 13/025* (2013.01); *D03D 41/00* (2013.01); *D03D 47/16* (2013.01)

(58) Field of Classification Search
CPC ..... D03C 13/025; D03C 7/06; D03D 13/00; D03D 41/00; D03D 47/16
See application file for complete search history.

(56) References Cited

U.S. PATENT DOCUMENTS 5,947,165 A * 9/1999 Speich ..... D03C 5/00 139/456
6,119,733 A * 9/2000 Arndt ..... D03D 47/38 139/194
(Continued)

FOREIGN PATENT DOCUMENTS

CN 101120129 A 2/2008
DE 102005061497 B3 11/2006
(Continued)

OTHER PUBLICATIONS

European Search Report dated Jan. 29, 2016, for EP Patent Application No. 15178073.

*Primary Examiner* — Khoa D Huynh
*Assistant Examiner* — Erick I Lopez

(57) ABSTRACT

A weaving loom produces a fabric (F), with warp yarns and in-woven weft yarns. The weaving loom includes a warp delivery unit, heddles to form a shed, a shedding mechanism for moving each heddle vertically along a vertical path, a weft insertion means for inserting each weft yarn in a shed and for releasing each weft yarn at a given location along a weft axis, and a weft delivery means for delivering each weft yarn to the weft insertion means. The weaving loom also includes a programmable clamping means for picking up a first end of each weft yarn and for releasing each weft yarn at any predetermined position along the weft axis, and a programmable mechanism including actuators for semi-closing the shed around the inserted weft yarn at any predetermined position along the weft axis.

11 Claims, 13 Drawing Sheets

(51) Int. Cl.

| | |
|---|---|
| ***D03C 13/00*** | (2006.01) |
| ***D03D 41/00*** | (2006.01) |
| ***D03D 47/16*** | (2006.01) |

(56) References Cited

U.S. PATENT DOCUMENTS

| | | | | |
|---|---|---|---|---|
| 2011/0000576 | A1* | 1/2011 | Yokokawa | D03C 13/025 139/110 |
| 2012/0190257 | A1* | 7/2012 | Siebert | E01C 13/08 442/239 |
| 2014/0342630 | A1* | 11/2014 | Amtmann | B29C 70/021 442/203 |

FOREIGN PATENT DOCUMENTS

| | | | |
|---|---|---|---|
| EP | 2832906 | A1 | 4/2015 |
| WO | 2013011119 | A1 | 1/2013 |
| WO | 2013104056 | A1 | 7/2013 |

* cited by examiner

WEAVING LOOM FOR IMPLEMENTING A METHOD FOR WEAVING A FABRIC AND NEAR-NET SHAPE FABRIC MADE ON SUCH A WEAVING LOOM

TECHNICAL FIELD OF THE INVENTION

The present invention relates to a method for weaving a fabric, with warp yarns and inwoven weft yarns, on a loom. This invention also relates to a near-net shape fabric woven via such a method and to a weaving loom for weaving a near-net shape fabric via such a method.

BACKGROUND OF THE INVENTION

In the field of composite fabric manufacturing, it is known to obtain so-called "3D products" by using different materials for the warp and weft yarns of a fabric. For instance, in the field of aircraft and automotive industry, there is a need to manufacture composite structures with a form close to their final form, in order to save expensive material, such as carbon, and in order to avoid weaving large quantities of material which will be later removed from the final fabric and thrown away.

Usually, manufacturers define the portions of a fabric where a tridimensional pattern is to be created. Then, they draw reinforced weft yarns in these portions which are later cut to fit the shape of the final product. The parts of the product which are cut away are wasted and may include a significant quantity of expensive material including, for instance, reinforced fibers made of carbon, Kevlar (registered trademark), glass, etc. Once the fabric has been cut to fit its final shape, it is usually installed within a mold where it is thermoset with added resin.

In classical looms, weft yarns are drawn into the open shed and extend all through the width the fabric. Such known looms are not flexible, because weft yarns are inserted with a fixed length in the whole fabric.

In order to save some material, WO-A-2013/104056 teaches to weave blanks of reinforcement fibers. The full fabric contains reinforced warp threads and a part of these threads is later cut away, so that material waste is not fully avoided.

EP-A-2 531 639 explains how to add weft effects in order to obtain a pattern on a fabric. The added weft thread is endless and the technology required for implementing this method is based on needles, which is complicated.

EP-A-2 832 906 discloses a method for weaving a fabric with short length weft threads and non-woven side parts, which must be cut away. The short weft yarns are likely to be imprecisely positioned with respect to the warp yarns if a high speed loom is used.

On the other hand, it is known from FR-A-2 902 444 to use electrical actuators in order to drive heddles of a weaving loom and to adapt the shed, depending on parameters provided by the weaver. Weft yarns are supposed to extend all through the width of the fabric.

SUMMARY OF THE INVENTION

This invention aims at solving these problems with a new method which allows efficient weaving of a near-net shape fabric and avoid, to a large extent, material waste.

To this end, the invention concerns a method for weaving a fabric, with warp yarns and inwoven weft yarns, on a loom which comprises a warp delivery unit; heddles for moving warp yarns in order to form a shed; a mechanism for moving each heddle vertically along a vertical path; weft insertion means for inserting each weft yarn in a shed and for releasing the weft yarn at a given location along a weft axis; and weft delivery means for delivering weft yarns to the weft insertion means. This method comprises, for at least two consecutive picks, at least the following steps consisting in:

a) opening the shed;
b) picking, by the weft insertion means, of a first end of a weft yarn presented by the weft delivery means;
c) drawing the weft yarn into the shed, along the weft axis;
d) releasing the weft yarn at the predetermined position along the weft axis;
e) withdrawing the insertion means from the shed; and
f) beating-up the weft yarn.

During step c), the shed is closed around the inserted weft yarn, by moving warp yarns of a predetermined group of warp yarns to a semi-closed position.

Thanks to the invention, the partially closed shed, that is the shed at the level of the group of warp yarns in the semi-closed position, allows guiding the weft yarn during its translational movement along the weft axis, even if this weft yarn has been cut to a relatively short length in order to be installed within the shed only on a portion of the total width of the fabric. In particular, the warp yarns in the semi-closed position can contact the inserted weft yarn, from above and/or from below this inserted weft yarn, when it is drawn into the shed. Moreover, the warp yarns in the semi-closed position can also allow tensioning the weft yarn by friction on this yarn during its translational movement. The semi-closed position is defined as a position where two warp yarns of the predetermined group of warp yarns which respectively belong to the upper shed and to the lower shed are separated vertically by a distance which is smaller than or equal to 1.5 times the nominal diameter of the weft yarn, preferably smaller than or equal to 1.2 times this diameter.

The invention allows cutting a weft yarn at any desired length, this length being adjusted from one pick to the other if necessary, and dropping or releasing this weft yarn at any given location along the width of the fabric, this location being also adjustable from one pick to the other. Thus, a great versatility can be obtained with the method of the invention, which allows manufacturing a near-net shape fabric where reinforced weft yarns are cut to their actual useful length, with no waste, or a very slight waste of material.

According to further aspects of the invention which are advantageous but not compulsory, the method of the invention might incorporate one or several of the following features, taken in any technical admissible configuration:

- During step c), closing of the shed around the weft yarn is implemented via individual actuators, each individual actuator controlling the position of one heddle along its reciprocal path and the corresponding shed opening angle.
- During step c), closing of the shed around the weft yarn occurs gradually along the weft axis depending on the position of the weft yarn along this axis.
- Step c) includes the following elementary steps c1) drawing the weft yarn into the shed, up to a first axial position along the weft axis; c2) clamping the weft yarn in the weft delivery unit; c3) cutting the weft yarn with a predetermined length; c4) further drawing the cut weft yarn into the shed up to a second axial position along the weft axis; whereas closing of the shed around the weft yarn occurs during elementary step c1) and/or during elementary step c4

During elementary step c1), the shed is closed around the weft yarn at least in the vicinity of a cutting device used in elementary step c3).

Alternatively, prior to step b), the weft yarn is cut at a predetermined length.

During step c), the shed is closed at least around a second end of the weft yarn, which is opposite to the first end.

The method comprises a supplementary step g), implemented between steps e) and f) and consisting in re-opening the shed for at least a portion of the predetermined group of warp yarns.

For each pick, the position of each heddle along its reciprocal path is controlled on the basis of a predetermined profile selected between at least two of the following profiles:

- a first profile based on a first generic profile, which goes gradually from a fully closed portion to a fully open position and then back to the fully closed position,
- a second profile based on a second generic profile, which goes gradually from a fully closed position to an open position, then to a semi-closed position, and finally back to the fully closed position,
- a third profile based on a third generic profile, which goes gradually from a fully closed position to an open position, then to a semi-closed position, then to an open position and finally back to the fully closed position.

Each predetermined profile is defined by at least one parameter representative of its deviation from the corresponding generic profile.

At least two weft yarns, whose cumulated total length is smaller than the fabric width, are inserted within the shed during successive picks and are released, during step d), at different locations along the weft axis, with no overlap between these locations.

For weaving a fabric including different layers of superposed weft yarns, these layers are obtained either by simultaneously inserting superposed weft yarns into superposed sheds or by successively inserting weft yarns into successive sheds, and by interlacing these groups of weft yarns via binding warp yarns in order to form stacks of weft yarns, and the location, the length of the superposed weft yarns and possibly the number of weft yarns in a stack are adjusted for each pick.

Moreover, the present invention relates to a near-net shape fabric which includes warp yarns and weft yarns and which is woven via the method identified here-above and which includes at least one weft yarn with a total length smaller than the width of the fabric and different layers of superposed weft yarns with different lengths.

Finally, the invention concerns a weaving loom for weaving a near-net shape fabric via the method identified here-above. This loom includes a warp delivery unit; heddles for moving warp yarns in order to form a shed; a mechanism for moving each heddle vertically along a vertical path; weft insertion means for inserting each weft yarn in a shed and for releasing the weft yarn at a given position along a weft axis; weft delivery means for delivering weft yarns to the weft insertion means; programmable clamping means for picking up the first end of the weft yarn at step b), for drawing the weft yarn into the shed at step c) and for releasing the weft yarn at step d), at any predetermined position along the weft axis; and a programmable mechanism including actuators for semi-closing the shed around the inserted weft yarn during step c), at any predetermined position along the weft axis.

Advantageously, this weaving loom also includes programmable cutting means for cutting each weft yarn at a length defined for each pick.

BRIEF DESCRIPTION OF THE DRAWINGS

The invention will be better understood on the basis of the following description, which is given in correspondence with the annexed figures and as an illustrative example, without restricting the object of the invention. In the annexed figures.

DETAILED DESCRIPTION OF SOME EMBODIMENTS

Figure 1:
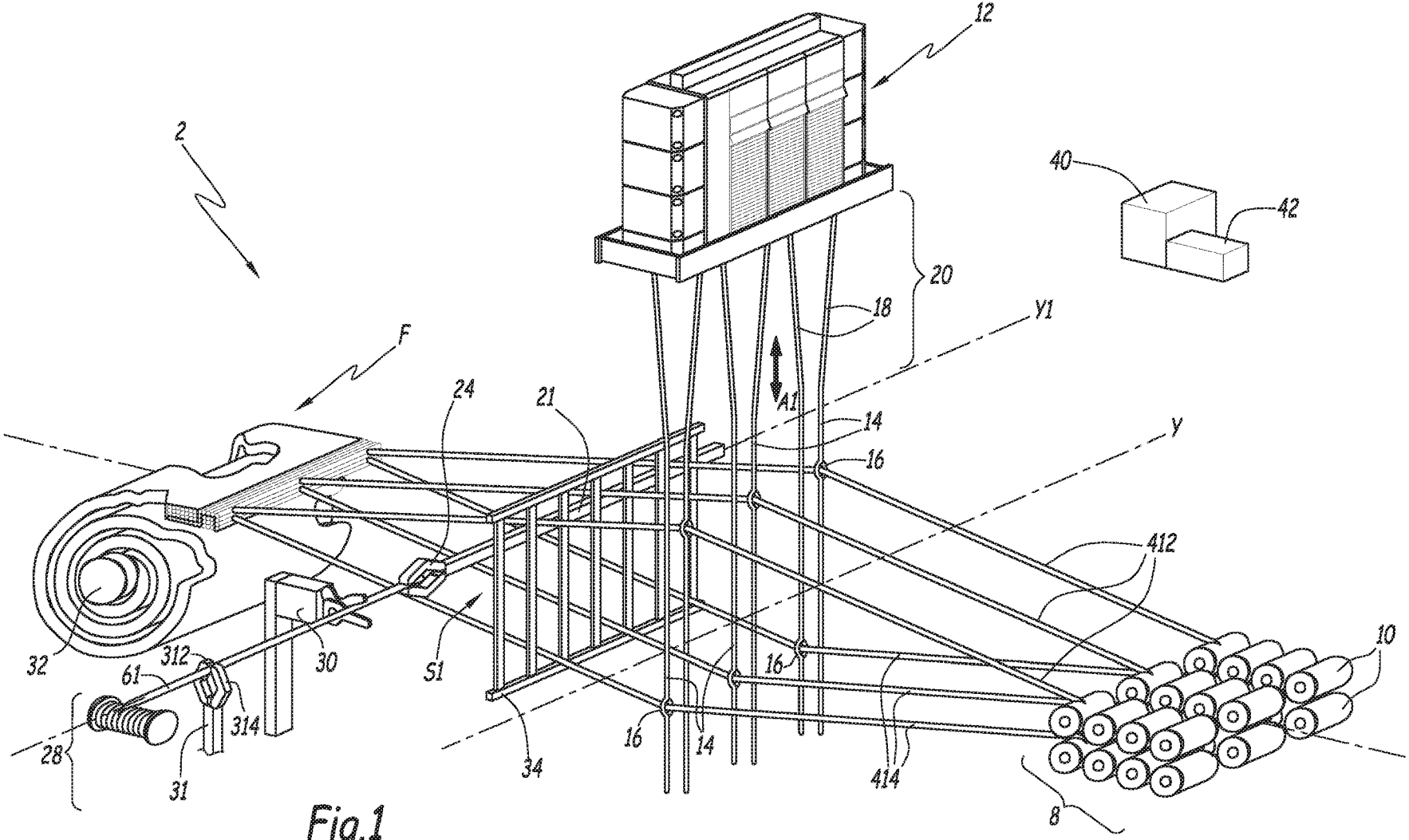
FIG. 1 is a schematic partial perspective view of a weaving loom according to the invention.

The method of the invention can be implemented on a loom of the type shown on FIG. 1. This loom 2 is used to weave together some warp yarns 412, and 414 and some weft yarns 61 and 62.

On FIG. 1, loom 2 defines a single shed S1, but the invention can also be implemented with a loom defining two superposed sheds S1 and S2, as shown on FIGS. 14 to 17.

The warp yarns come from a creel 8 which includes yarn packages 10 supplying the warp material to the loom. Alternatively, a warp beam stand can be used instead of creel 8. Creel 8 or the warp beam stand forms a warp delivery unit for loom 2. The warp yarns are made from polyester, polyamide or another relatively cheap thermoplastic material. Alternatively, they can be made from glass, carbon or another more elaborated material.

The weft yarns are reinforced with fibers or made of fibers, such as carbon, Kevlar, aramid or glass fibers. In this example, they are more elaborated and more expansive than warp yarns 4.

A Jacquard shedding mechanism 12 controls a plurality of heddles 14, each heddle being provided with an eyelet 16 for guiding a respective warp yarn coming from creel 8. Only six heddles and six warp yarns are shown on FIG. 1 but, in practice, loom 2 includes several thousand of warp yarns and heddles 14. Each heddle is connected to a corresponding cord 18 which belongs to a harness 20. Each cord 18 is individually driven by an electric actuator Jacquard of shedding mechanism 12. Non represented elastic means located below heddles 14 exert on each one of these heddles a downwardly oriented effort. Thus, shedding mechanism 12 allows controlling the vertical position of each heddle 14 along a vertical reciprocal path, represented by double arrow A1 on FIG. 1, and the corresponding shed opening angle.

This allows forming the shed S1 designed to accommodate one weft yarn 61. Shed S1 is defined between upper warp yarns 412 and lower warp yarns 414.

X denotes a longitudinal axis of loom 2 which is parallel to the length of a fabric F woven on this loom. Y denotes a transverse axis of loom 2 which is parallel to the width of fabric F. Shed S defines a weft axis Y1, which is parallel to axis Y and along which weft yarn 61 is inserted within shed S.

One rapier 21 is used to draw weft yarn 61 into and within shed S1.

Rapier 21 is provided with a terminal clamp 24 which is adapted to grip a end of warp yarn 61.

Warp yarns 61 is supplied from a yarn package 26 which belongs to a weft delivery unit 28.

According to a non-represented optional feature of the invention, loom 2 can incorporate a set of different yarn packages, each yarn package including a weft yarn with a given type of reinforcement fiber like carbon, Kevlar, aramid or glass, or a weft yarn with a different nominal diameter. Then, weft delivery unit 28 also includes a weft selector in order to deliver the required weft yarns 61 and 62 for each pick during weaving.

Weft delivery unit 28 also includes a cutting device or scissors 30 located between yarn packages 26 and shed S1. Weft delivery unit 28 is also provided with holding means, in the form of clamp 31, capable of presenting weft yarn 61 to rapier 21. Such a clamp 31 includes two smooth jaws 312 and 314 movable between an opened position, which allows movement of the weft yarn along weft axis Y1, and a blocked position where they prevent such a movement. For the sake of simplicity, clamp 31 is represented only FIG. 1.

A beam 32 is used to wind fabric F woven on loom 2.

Rapier 21 is driven in translation along axis Y1 via non-represented driving means which include, for instance, an electric actuator.

Loom 2 also includes a reed 34 which is driven by a non-represented sley mechanism in order to beat up the inserted weft yarn 61.

An electronic control unit 40 is used to drive, amongst others, Jacquard shedding mechanism 12, cut device 30 and holding clamp 31 of weft delivery unit 28, the non-represented sley mechanism of reed 34, the non-represented driving means of rapier 21 and its clamp 24. Unit 40 is connected to all these controlled actuators via wire or wireless connections which are non-represented on FIG. 1, for the sake of simplicity.

A memory unit 42 is used for storing parameters relating to the design and to the type of material to be used, at each pick, for weaving fabric F. Some other parameters related to the shed opening and closing movements of heddles 14 can be stored in a library of control unit 40. The data stored in memory 42 and/or the library of unit 40 allow, in particular, a precise control of the vertical position of eyelets 16 via the electrical actuators of Jacquard shedding mechanism 12. In particular, the position of each eyelet 16 can be controlled on the basis of a profile defined for each pick during weaving of fabric F.

Figure 9:
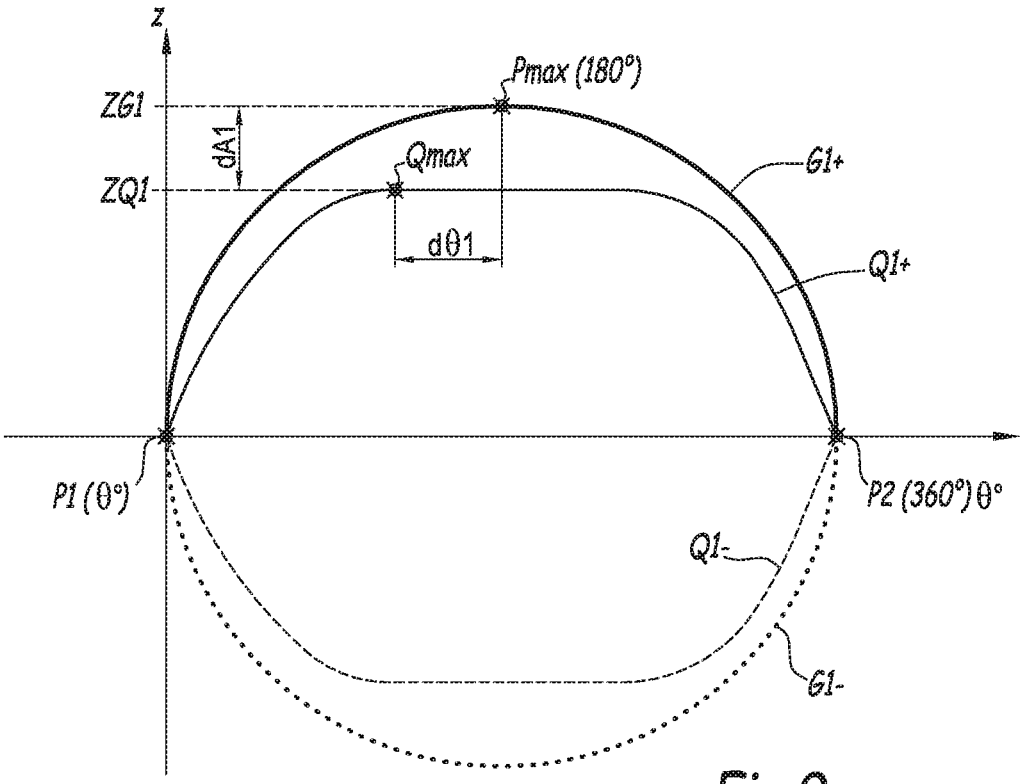
Figure 10:
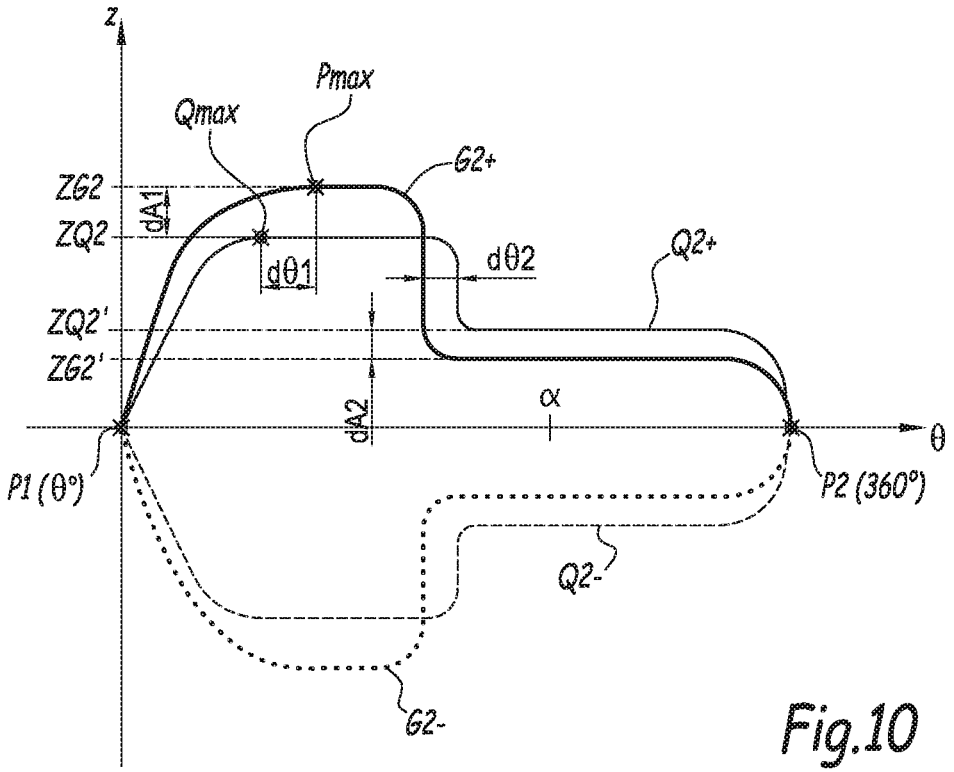
Figure 11:
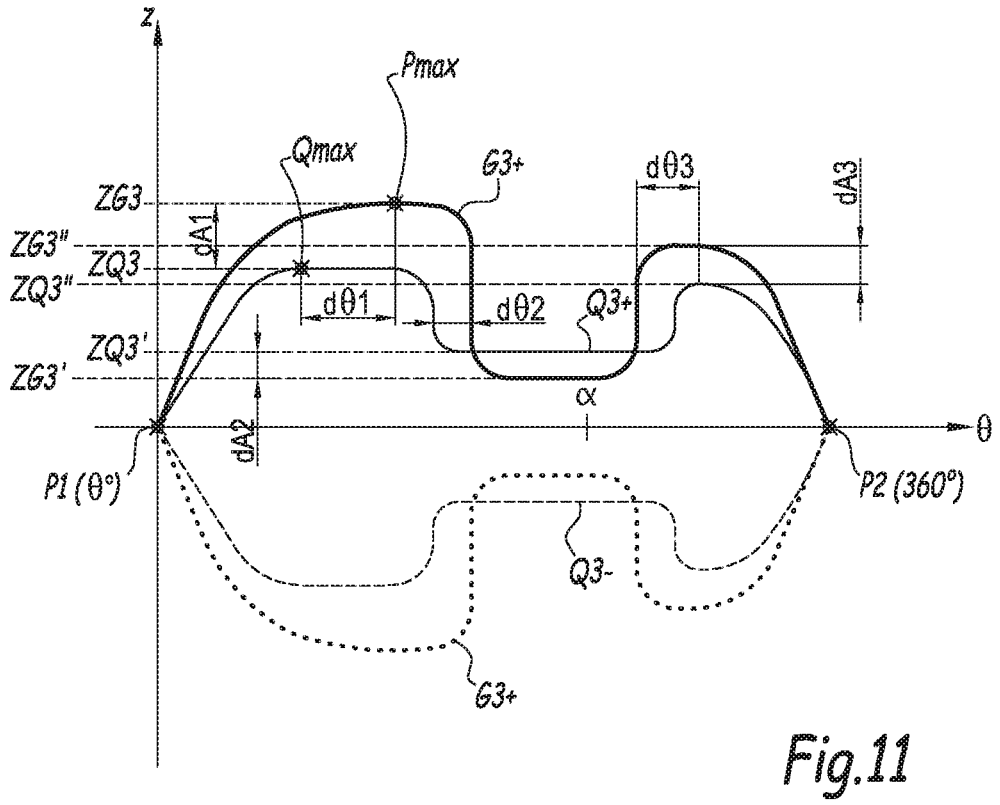

Such profiles are shown on FIGS. 9 to 11.

On each of these figures, the horizontal axis represents the rotation angle Θ of a main shaft of loom 2 during a pick. This rotation angle goes from 0° to 360° during a pick. It is representative of the time going by during a pick. Thus a profile could also be expressed, on FIGS. 9 to 11 as a function of time. On these figures, z represents the height of an eyelet 16 of a heddle 4. On this axis, 0 corresponds to the crossing plane π0 of warp yarns. After beat up, the warp yarns move up or down from the crossing plane to form the expected shed for the next pick considering the pattern to be woven.

On FIG. 9, a generic positive O-profile G1+ is represented which corresponds roughly to a semi-circular path between an initial position P1, at Θ=0°, where the corresponding warp yarn is in crossing plane π0, and a final position P2, at Θ=360°, where the warp yarn is also in the crossing plane π0 which corresponds to a fully closed position of the shed. Between these two positions P1 and P2, generic profile G1+ goes through a third point Pmax, for Θ equal to about 180°, where height z has a maximum ZG1 which corresponds to a top fully opened position of the shed.

This generic profile G1+ is positive for the upper shed. A negative generic profile G1−, symmetric of generic profile G1+ with respect to the horizontal axis, is used for the lower shed.

When a profile Q1+ is based on generic profile G1+, it can be defined by its deviation with respect to this generic profile. In particular, the maximum amplitude ZQ1 of profile Q1+ can be defined by its difference dA1 with respect to maximum amplitude ZG1. Moreover, an angle offset dΘ1 can be defined between point Pmax and the point Qmax at which profile Q1+ reaches its maximum amplitude ZQ1. Thus, different profiles Q1+ based on generic profile G1 can be defined, with different values of dA1 and dΘ1.

Similarly, a lower profile Q1− can be based on generic profile G1− and defined by deviations similar to deviations dA1 and dΘ1.

FIG. 10 shows a P-shaped generic profile G2. This generic profile goes from a first position P1 to a second position P2 defined as for FIG. 9. Generic profile G2+ includes a first plate at a maximum height ZG2 which corresponds to an opened shed position and a second plate at a height ZG2', lower than height ZG2 with respect to the crossing plane π0. An almost vertical transition connects these two plates. This generic profile G2+ is used for controlling upper warp yarns.

Another generic profile P2−, symmetric of generic profile G2+ with respect to the horizontal axis, is used for controlling lower warp yarns.

A profile Q2+ based on generic profile P2+ is defined by its deviation with respect to this generic profile, this deviation being defined by amplitude differences dA1 and dA2 and angle differences dΘ1 and dΘ2 for representative points of this profile. dA1 and dΘ1 are defined as on FIG. 9. dA2 is defined as the difference in height between height ZG2' and the height ZQ2' of the second plate of profile Q2+ with respect to plane π0. dΘ2 is defined as the angle difference between the point at which profile G2+ reaches height ZG2' and the point at which profile Q2+ reaches height ZQ2'.

The same approach can be used for the negative profiles Q2− and G2−.

The generic profile G3+ represented on FIG. 11 is globally C-shaped and includes a first plate, at a maximum height ZG3 roughly equal to height ZG2 and which corresponds to an opened position of the shed. Generic profile G3+ also includes a second plate at a height ZG3' roughly equal to height ZG2' and which corresponds to a semi-closed position of the shed. Finally, generic profile G3+ includes a third plate or high portion at a third height ZG3" close to height ZG3 and higher than height ZG3'. Height ZG3 also corresponds to an opened position of the shed. A profile Q3+ based on generic profile G3+ is defined by its deviation with respect to this generic profile thanks to three vertical offsets dA1, dA2 and dA3 and three angular offsets dΘ1, dΘ2 and dΘ3. dA1, dA2, dΘ1 and dΘ2 are defined as on FIG. 10. dA3 is defined as the difference in height between height ZG3" and the height ZQ3" of the third plate of profile Q3+ with respect to plane π0. dΘ3 is defined as the angle difference between the point at which profile G3+ reaches height ZG3" and the point at which profile Q3+ reaches height ZQ3".

Similarly, a generic negative profile G3−, symmetrical of generic profile G3+ with respect to the horizontal axis, can be defined and serves as a basis for an actual negative profile Q3−.

Deviation parameters dA1, dA2, dA3, dΘ1, dΘ2 and/or dΘ3 are defined for each pick and for each heddle, in order to precisely control the sheds S1 and S2.

Figure 2:
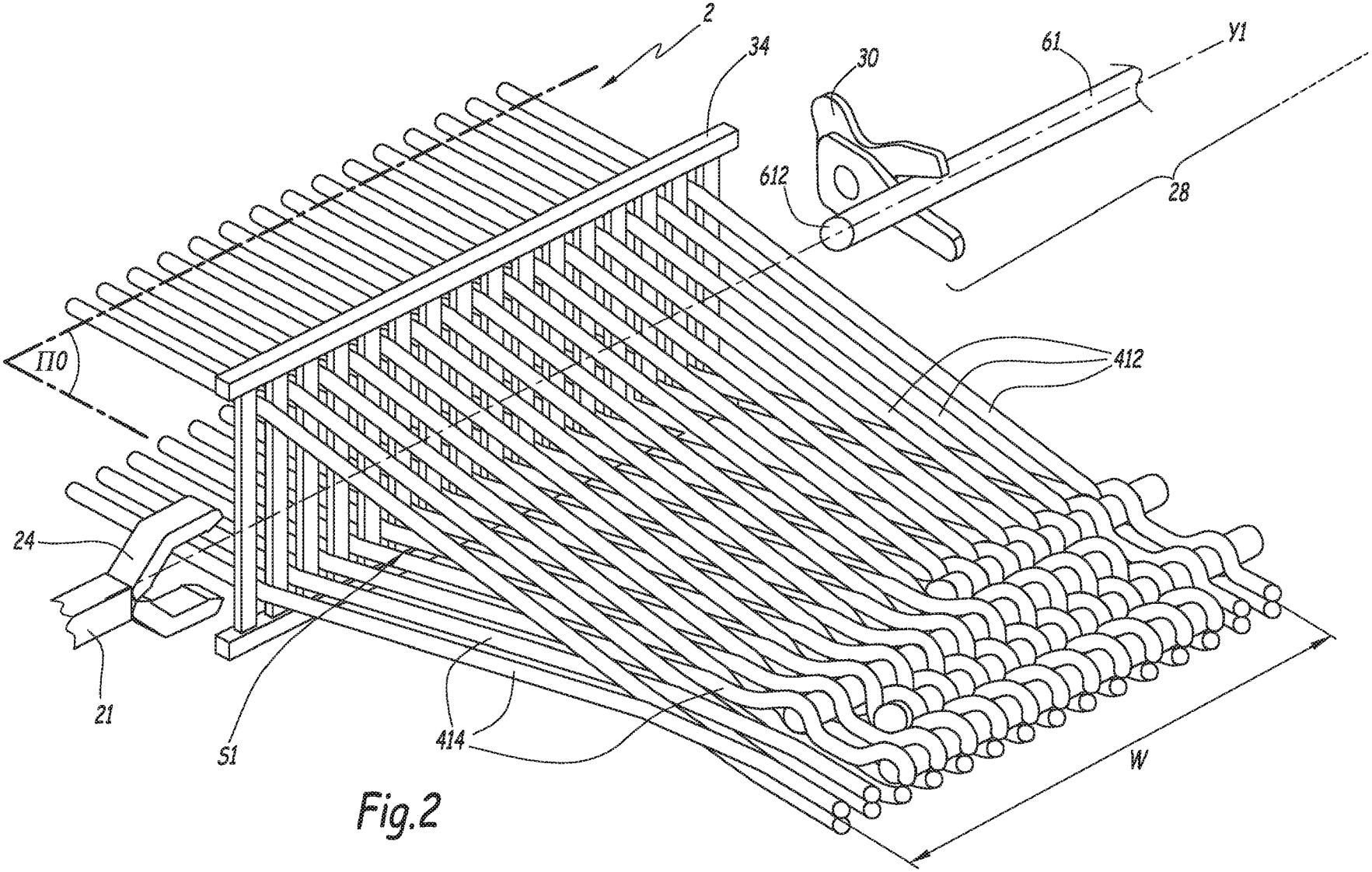
FIG. 2 is a partial perspective view of the weaving loom of FIG. 1 during a first step of a method according to the invention.

A first method according to the invention is represented on FIGS. 2 to 8 on loom 2. FIG. 2 represents the loom at the beginning of a pick. Rapier 21 is out of shed S1 which is formed between a layer of upper warp yarns 412 and a layer of lower warp yarns 414 which extend respectively above and under crossing plane π0. Weft axis Y1 is included within plane π0.

In the configuration of FIG. 2, clamp 24 is outside of shed S1, in an opened configuration. At the beginning of each pick, the drive means of rapier 1 and the cut device 30 receive instructions from electronic control unit 40 as to the length L61 of the weft yarn 61 to be inserted within the shed S1 and the location of this weft yarn along the width W of the fabric F, this width being parallel to axes Y and Y1. Moreover, the drive means of rapier 21 receive instructions as to the linear displacement profile of rapier 21, in particular in terms of maximum speed and acceleration. Actually, these parameters can vary depending on the type of weft yarn to be used.

Figure 3:
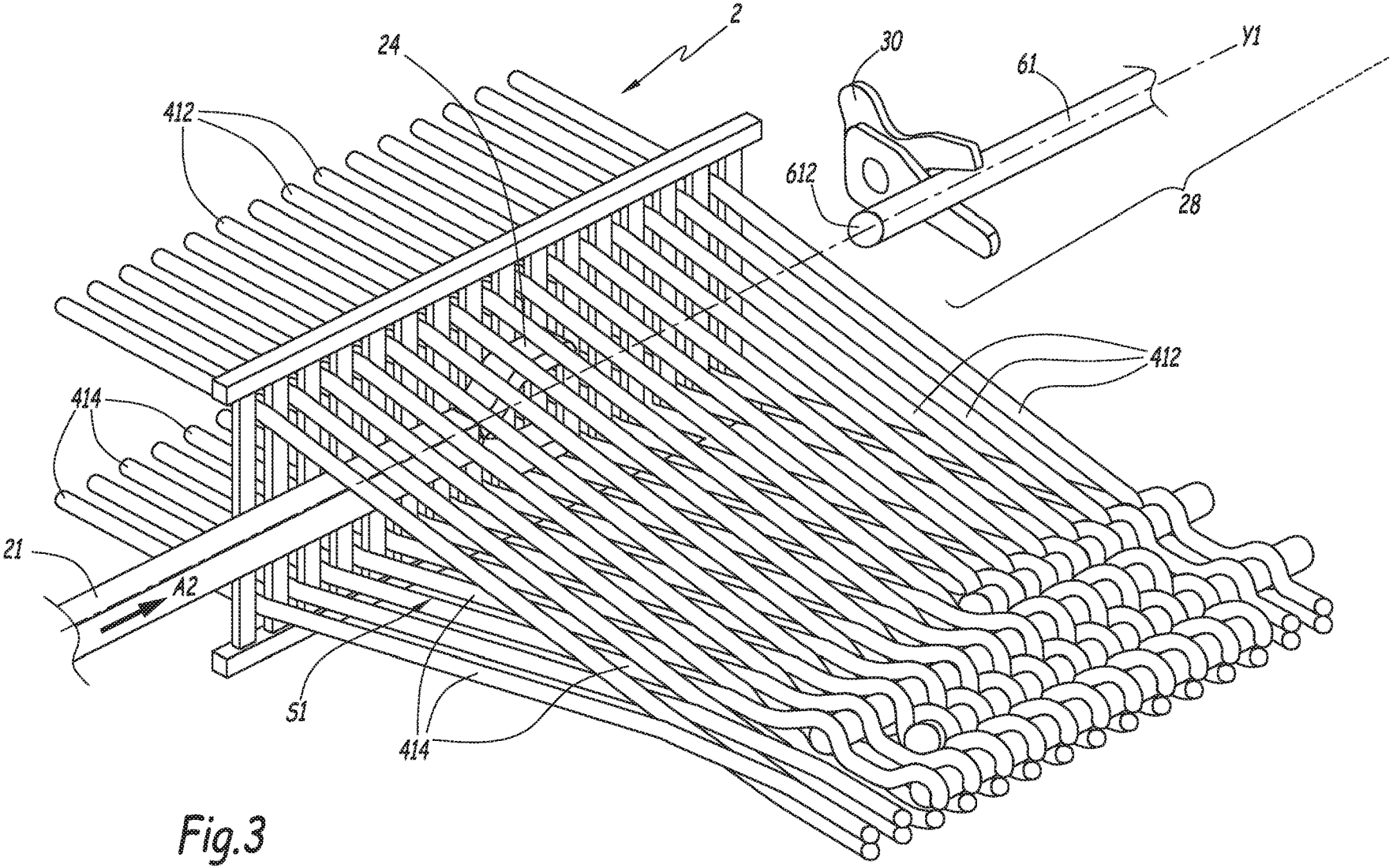
FIGS. 3 to 6 and 8 are perspective views similar to FIG. 2 for subsequent steps of the first method of the invention.

In the configuration of FIG. 3 and as shown by arrow A2, rapier 21 moves within the shed S1 according to the displacement profile instructions received from electronic control unit 40, towards a free 612 end of weft yarn 61 which is held in position within weft delivery unit 28 by the non-represented holding means.

Figure 4:
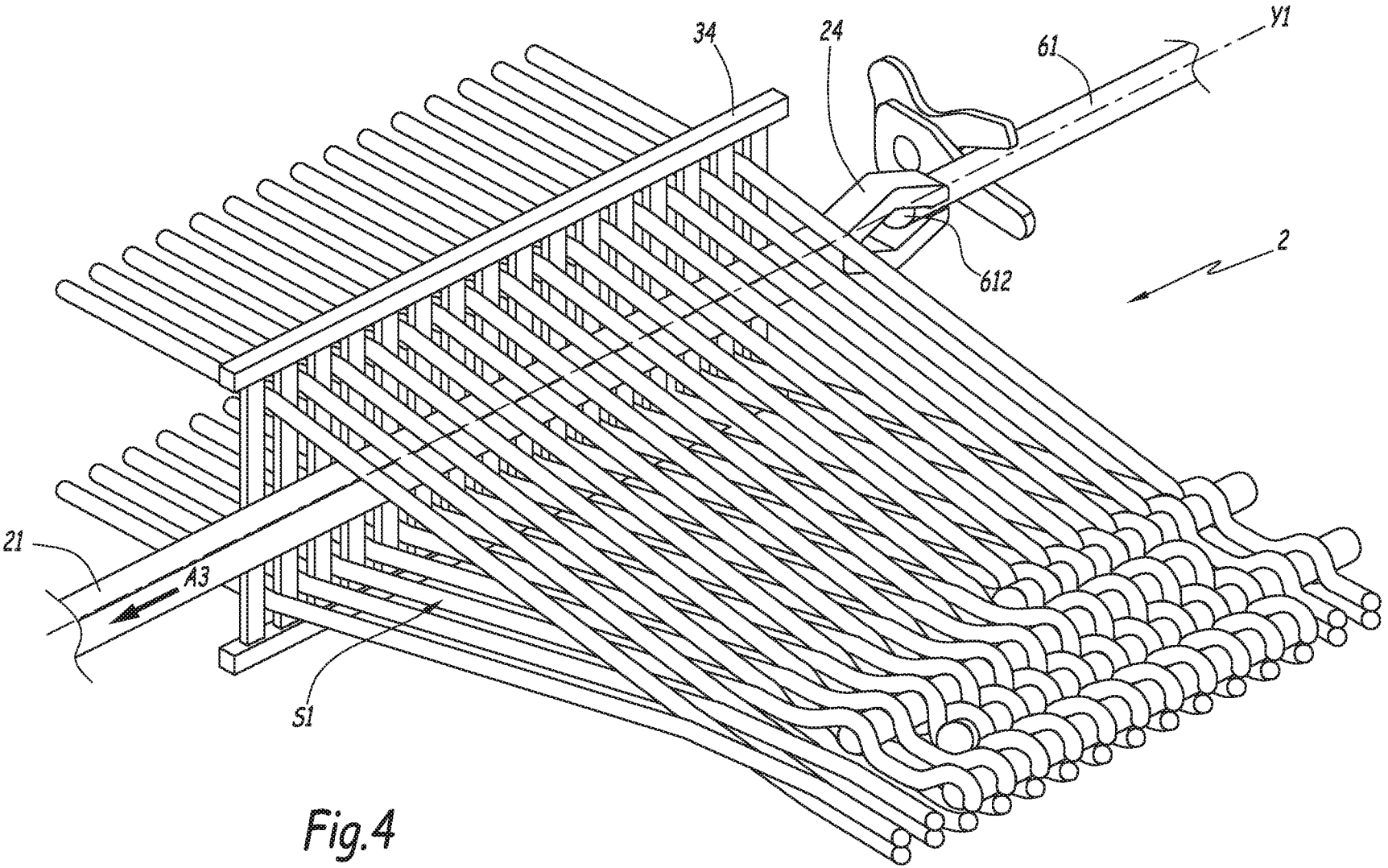

In the configuration of FIG. 4, clamp 24 has reached end 612 and closes on this part of weft yarn 61 so that it picks up this end 612.

Figure 5:
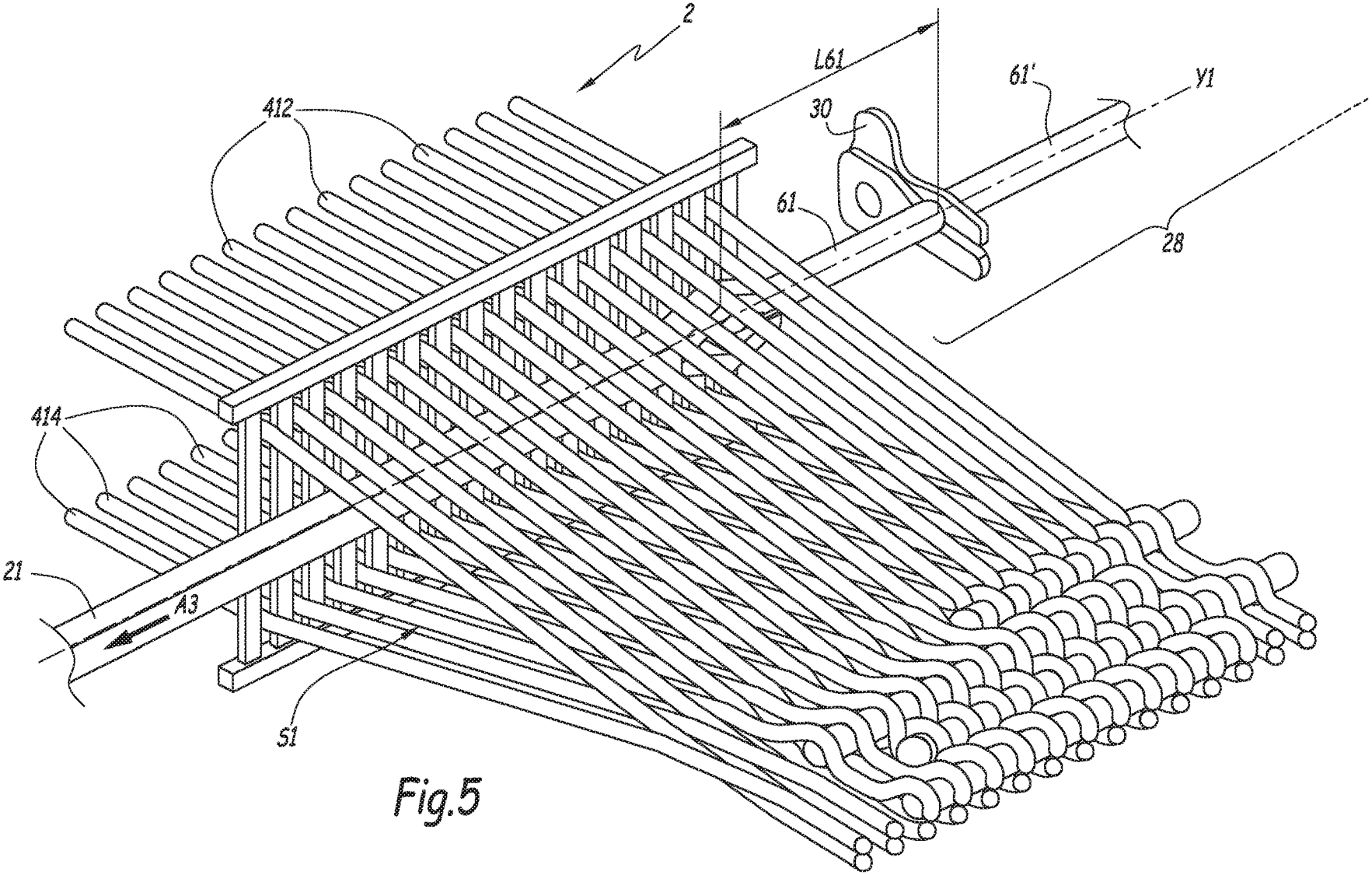

Then, as shown by arrow A3 on FIG. 5, rapier 21 is driven in a reverse direction as compared to the movement of FIG. 3, so that clamp 24 which has previously gone through shed S1 on the whole width W of fabric F comes back within shed S1 and draws weft yarn 61 into the shed, along weft axis Y1.

During this movement, the holding means of weft delivery unit 28 are released, so that weft yarn 61 can freely move along axis Y1.

When the distance between the end 612 of weft yarn 61 and scissors 30 equals the predetermined length L61 defined for weft yarn 61 at the given pick, rapier 21 stops its translational movement along axis Y1 and the holding means of weft delivery unit 28 are actuated to clamp the weft yarn. Then, scissors 30 are actuated to cut weft yarn 61 at length L61, as shown on FIG. 5.

61' denotes the part of weft thread remaining in weft delivery unit 28 after actuation of scissors 30, ready for next pick.

Then, the movement of rapier 21 in the direction of arrow A3 starts again, so that clamp 24 further draws the cut weft yarn 61 in to shed S1.

In other words, starting from the taking position of FIG. 4 where the jaws of clamp 24 catch the end 612 of weft yarn 61, rapier 21 moves the weft yarn into a first axial position along axis X1, which is represented on FIG. 5, where the weft yarn 61 is held in position by the holding means of weft delivery unit 28. Then, after weft yarn has been cut in this first position and starting from this first position, rapier 21 further draws the cut weft yarn into the shed up to a second axial position along axis Y1 which is represented on FIG. 6.

Figure 6:
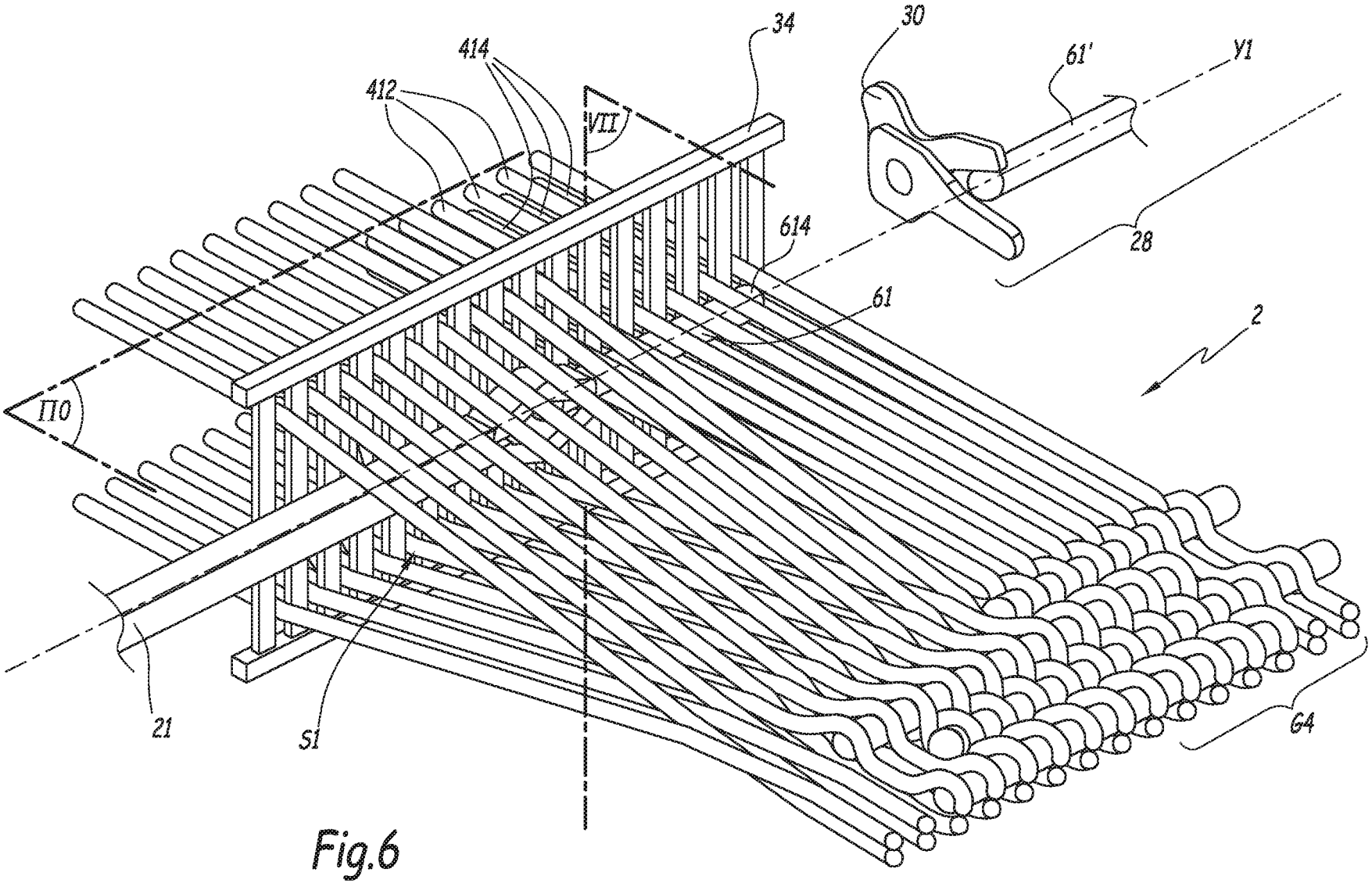

During insertion, a group G4 of warp yarns is brought to a semi-closed position where all the upper warp yarns 412 of this group G4 move downwardly towards plane π0, whereas all the lower warp yarns 414 of this group G4 move upwardly towards plane π0 for the weft yarn to reach the second axial position on FIG. 6. In other words, shed S1 is closed around weft yarn 61 at the level of group G4 of warp yarns.

Figure 7:
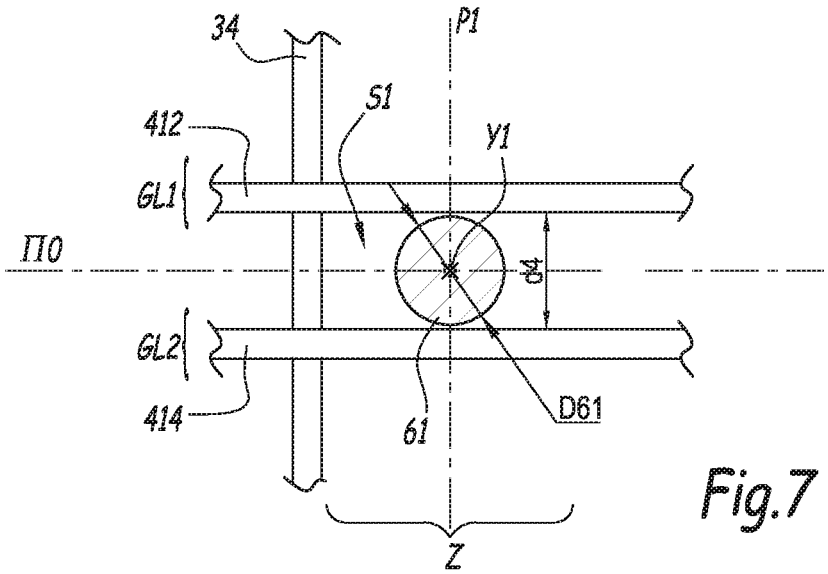
FIG. 7 is a cut view along plane VII on FIG. 6, FIGS. 9 to 11 are schematic views of several profiles used for controlling the heddles in the loom of FIG. 1, FIGS. 12 and 13 are perspective views respectively similar to FIGS. 5 and 6, for a second method of the invention.

As shown on FIG. 7, one considers a vertical plane P1 which includes axis Y1. One defines a zone Z which extends at less than 1 cm from plane P1, along axis X.

In this configuration, and as shown on FIG. 7, a vertical distance d4, measured within zone Z between upper and lower warp yarns 412 and 414 in group G4, is of the same order of magnitude as the nominal outer diameter D61 of weft yarn 61. The ratio d4/D61 is chosen smaller than or equal to 1.5, preferably smaller than or equal to 1.2. In practice, ratio d4/D61 is preferably chosen smaller than 1 when possible.

This allows building, around weft yarn 61 already engaged within shed S1, two guiding layers GL1 and GL2 respectively formed by upper warp yarns 412 and lower warp yarns 414 of warp yarns group G4 which make the shed close around the weft yarn 61. Guiding layers GL1 and GL2 are substantially parallel to each other. In other words, upper warp yarns 412 and lower warp yarns 414 in the semi-closed portion are substantially parallel. By "substantially parallel", one means that layers GL1 and GL2 diverge by less than 10°, preferably less than 5°

Guiding layers GL1 an GL2 are useful since cut weft yarn 61 cannot be held vertically by weft delivery unit 28 since its second end 614, opposite to end 612, is detached from the part 61' of weft thread 611 still present within weft delivery unit 28. Moreover, depending on transverse movements of cut weft yarn 61 with respect to axis Y1, upper warp yarns 412 and/or lower warp yarns 414 can contact cut weft yarn 61 moving within shed S1, from above and/or from below this inserted weft yarn and guide it.

Moreover, the ratio d4/D61 can be chosen so that a friction effort applies on cut weft yarn 61 when it is drawn into shed S1, from the first axial position to the second position, so that tensioning of the inserted weft yarn occurs. In such a case, the ratio d4/D61 is also preferably chosen smaller than or equal to 1.

Advantageously, the definition of yarn group G4 is variable during a pick. In such a case, closing of the shed S1 around weft yarn 61 can occur gradually along weft axis Y1, as weft yarn 61 moves along this axis, so that the semi-closed shed follows weft yarn 61 along this axis.

At the beginning and when weft yarn 61 is in the second axial position of FIG. 6, yarn group G4 includes warp yarns located in the vicinity of scissors 30, that is in the entry zone of shed S1 of weft yarn 61.

Then, when cut weft yarn 61 follows rapier 21 towards the exit zone of shed S1, along axis Y1, the definition of yarn group G4 changes, so that most of cut weft yarn 61 remains located between two guiding and potentially frictionning layers GL1 and GL2, all along its travel path within shed S1, after the second position mentioned here-above.

A warp yarn 412 or 414 can belong to yarn group G4 only once clamp 24 has gone beyond this warp yarn toward the exit zone of shed S1.

According to a variant of the method of the invention, warp yarn 61 can be cut to the desired or predetermined length L61 prior to being picked up by clamp 24. Then, there is no need to use the second axial position mentioned here-above and the cut weft yarn can be continuously drawn into and within shed S1, while the shed is gradually closed around the inserted and moving weft yarn 61.

According to another variant of the method, the shed is not closed gradually but a group G4 of warp yarns is brought at the same time to a semi closed position at the end of step c) or at the end of step c4).

The translational movement of rapier 21 and cut weft yarn 61 in the direction of arrow A3 goes on up to when weft yarn 61 reaches, along axis Y1, a predefined third position which corresponds to its desired location along the width W of fabric F. Actually, this third location, along axis Y1 is converted by electronic control unit into a position angle α, between 0 and 360°, where clamp 24 is supposed to release end 612 of weft yarn 61. Angle α is represented on FIGS. 10 and 11 as an angle larger than the angle for which a warp yarn has been brought to the semi-closed position. Different positions of angle α between 0 and 360° can be considered.

Figure 8:
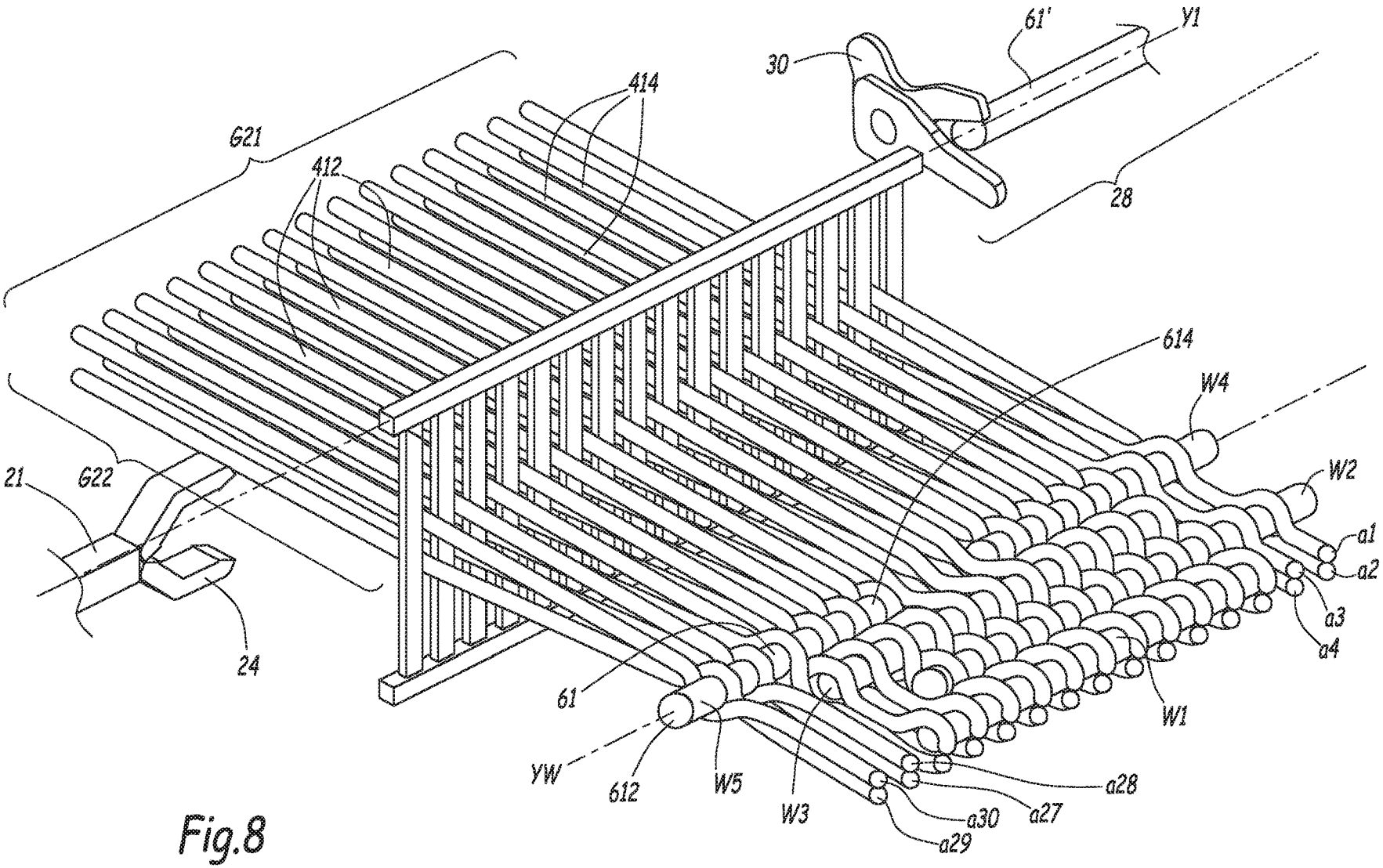

In the example of FIG. 8, weft yarn 61 has been brought, along axis Y1 beyond another weft yarn previously inserted into the shed. Once end 612 has been released, rapier 21 and its clamp 24 are withdrawn from shed S1. Then, reed 34 is used to push weft yarn 61 towards the remaining portion of fabric F and, since this weft yarn is offset from the previously inserted weft yarn, these two weft yarns are aligned with each other along an axis YW parallel to axes Y and Y1.

In order to obtain closing of the shed S1 around weft yarn 61, different positive profiles Q1+, Q2+, Q3+ and corresponding negative profile Q1−, Q2−, Q3− can be used, as explained here-above. Similarly, the first, second and third axial positions mentioned here-above are adjustable for each pick, depending on the warp yarn length L61 and its intended location along axis Y.

Profiles Q1+ and Q1− are used for warp yarns which do not belong to yarn group G4.

In yarn group G4, one can use Q2+ profiles based on generic profile G2 with heights ZG2' equal to half of distance d4. Parameters dA1, dΘ1, dA2 and dΘ2 are set for each warp yarn 412 along the weft direction in order to obtain progressive closing of shed S1 within group G4 around weft yarn 61. Similarly, Q2− profiles are used for weft yarns 414.

Alternatively or in combination, it is also possible to use Q3+ and Q3− profiles which implies re-opening the shed after passage of weft yarn 61 at the level of each warp yarn concerned by this profile. Here-again, parameters dA1, dΘ1, dA2, dΘ2, dA3, dΘ3 allow making the shed closing and re-opening progressive along axis Y1.

When Q3+ or Q3− profiles are used for warp yarns 412 and 414 which will remain unwoven with the weft yarn 61 after beating, the shed is slightly reopened before beating by reed 34, which facilitates the movement of weft yarns 61 along axis X since no friction with warp yarns 412 and 414 of group G4 slows this movement down because height ZQ3" is larger than half of diameter D61.

Profiles Q1+, Q1−, Q2+, Q2−, Q3+ and Q3− respectively based on generic profiles G1+, G1−, G2+, G2−, G3+ and G3− can be combined for each pick, that is for the insertion of each weft yarn 61.

The method described here-above is implemented for at least two successive picks. In practice, it is implemented for a number of picks corresponding to the zone of fabric F where weft yarns 61 are incorporated.

One considers the configuration of FIG. 8 where five weft yarns can be identified respectively with references W1, W2, W3, W4 and W5. These weft yarns have been introduced successively into shed S1, in that order. In this example, weft yarns W4 and W5 are aligned along axis YW. FIG. 8 shows thirty warp yarns each identified by a reference a1, a2, . . . ai, . . . a30.

Table 1 here-under shows the generic profile used for each warp yarn ai, for i an integer between 0 and 30, during the five picks corresponding to the insertion of weft yarns W1 to W5.

Warp yarn Weft 1 Weft 2 Weft 3 Weft 4 Weft 5
a1 (up on first line) G3− G2+ G3− G2+ G3−
a2 (down on first line) G3+ G2− G3+ G2− G3+
a3 G3− G2+ G3− G2+ G3−
a4 G3+ G2− G3+ G2− G3+
a5 G2− G2+ G2− G2+ G3−
a6 G2+ G2− G2+ G2− G3+
a7 G2− G2+ G2− G2+ G3−
a8 G2+ G2− G2+ G2− G3+
a9 G2− G2+ G2− G2+ G3−
a10 G2+ G2− G2+ G2− G3+
a11 G2− G2+ G2− G2+ G3−
a12 G2+ G2− G2+ G2− G3+
a13 G2− G2+ G2− G3− G3−
a14 G2+ G2− G2+ G3+ G3+
a15 G2− G2+ G2− G3− G3−
a16 G2+ G2− G2+ G3+ G3+
a17 G2− G2+ G2− G3− G3−
a18 G2+ G2− G2+ G3+ G3+
al9 G2− G2+ G2− G3− G3−
a20 G2+ G2− G2+ G3+ G3+
a21 G2− G2+ G2− G1− G2+
a22 G2+ G2− G2+ G1+ G2−
a23 G2− G2+ G2− G1− G2+
a24 G2+ G2− G2+ G1+ G2−
a25 G2− G1− G2− G1− G2+
a26 (down on first line) G2+ G1+ G2+ G1+ G2−
a27 (down on first line) G1− G1− G1− G1− G2+
a28 G1+ G1+ G1+ G1+ G2−
a29 G1− G1− G1− G1− G2+
a30 (up on last line) G1+ G1+ G1+ G1+ G2−

This table shows that different generic profiles can be used, depending on the final configuration to be obtained for each weft yarn. Moreover, each of these generic profiles is adapted with deviation parameters dA1, dΔ1 . . . as explained here-above, in order to adjust the shed S1 to the actual length L61 and diameter d61 of each weft yarn 61.

FIG. 8 also shows that weft yarns W4 and W5, which have been inserted in shed S1 during two successive picks, have been released and are located at different locations along axis YW, with no overlap between these two locations. In other words, warp yarns W4 and W5 are offset from each other along axis YW. Moreover, their cumulated total length, that is the sum of length L61 and the length of weft yarn W4, is smaller than width W.

Figure 12:
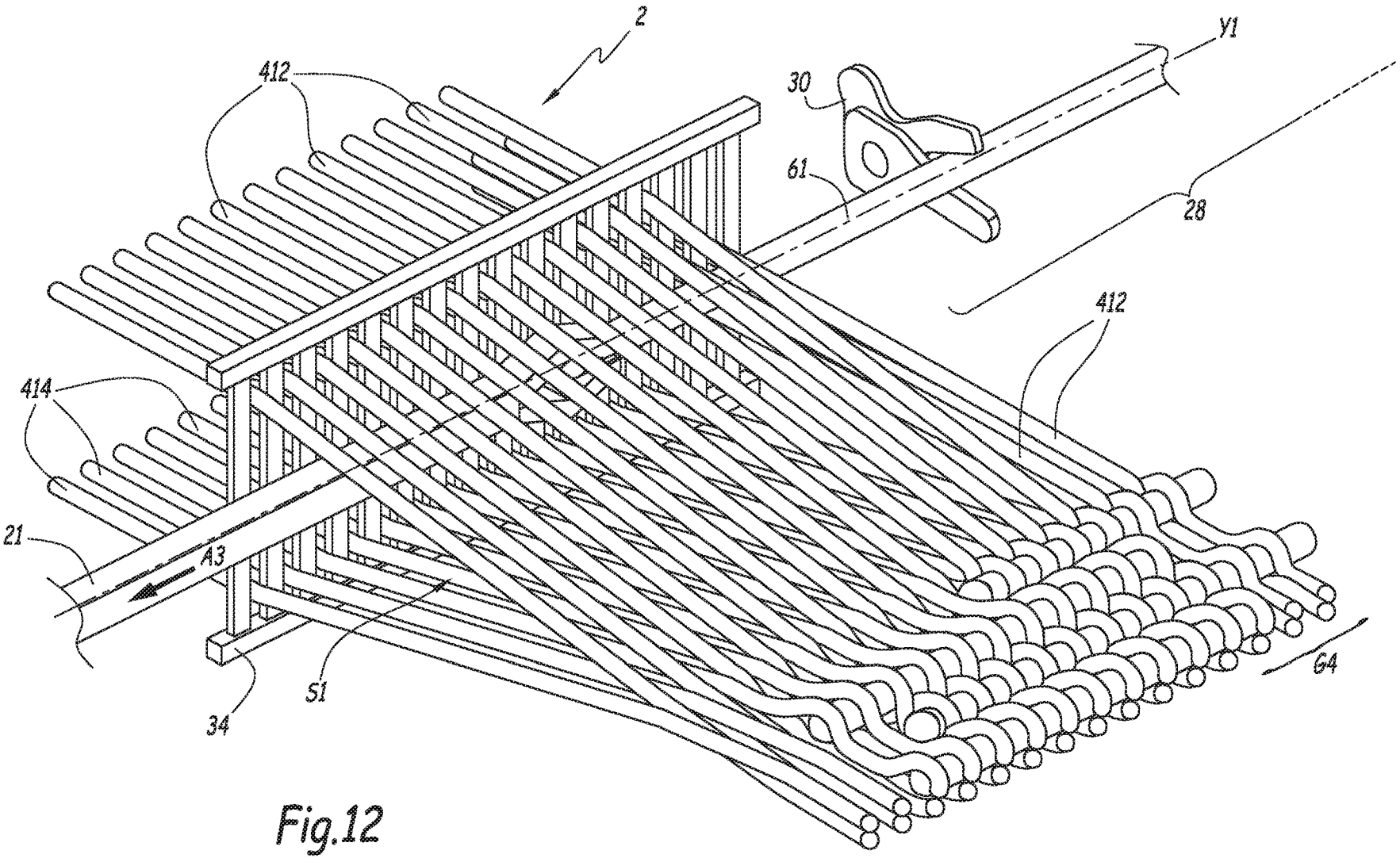
Figure 13:
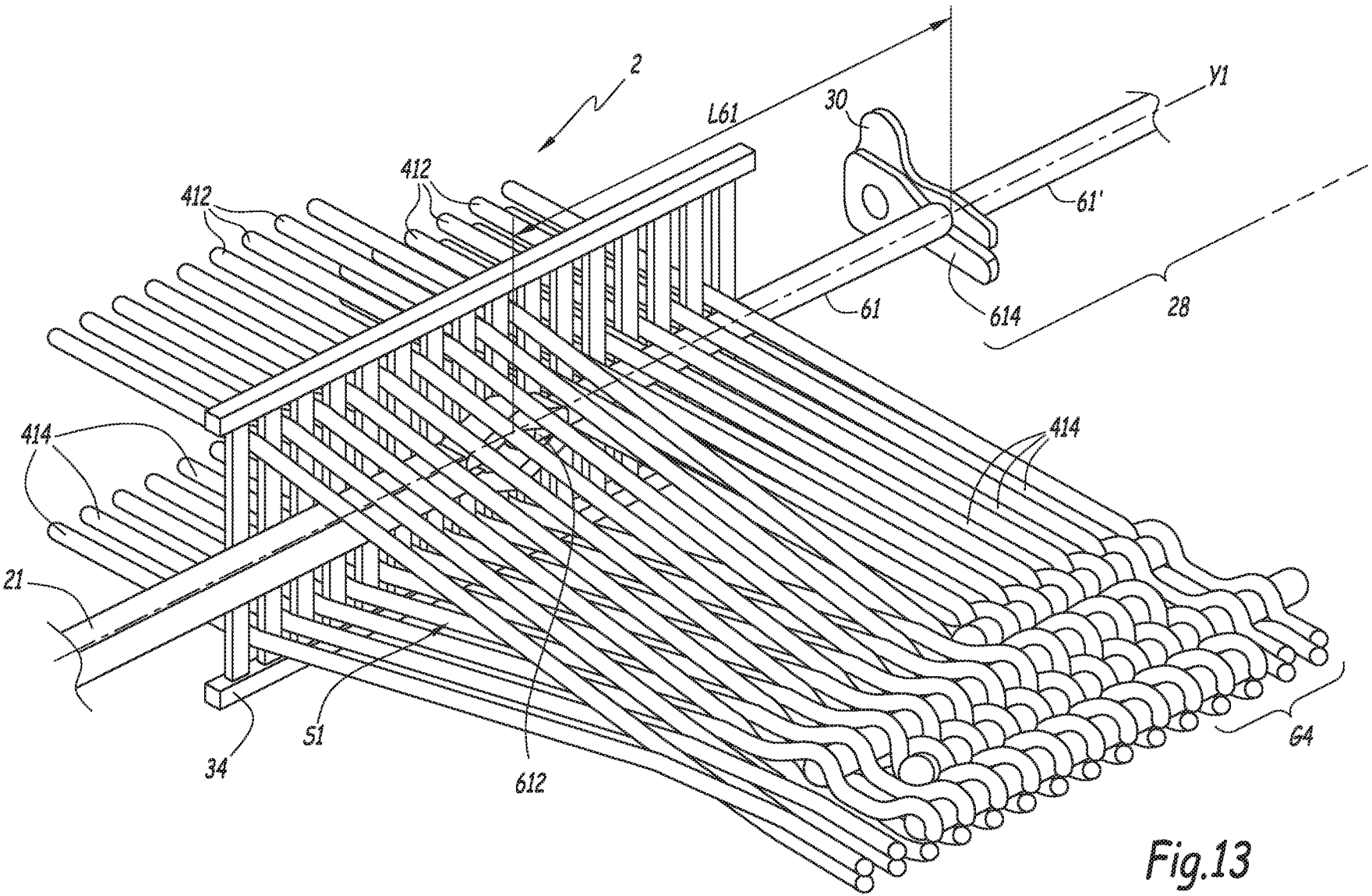

In the second method of the invention represented on FIGS. 12 and 13, weft yarn 61 is drawn into the shed S1, as shown by arrow A3 on FIG. 12, whereas some warp yarns 412 and 414 come to their closure position and form yarn group G4, as shown also on FIG. 12. Group G4 is located in the vicinity of the scissor but alternatively, like for any other embodiment, closure of the shed could occur later. The number of yarns 412 and 414 of yarn group 44 increases progressively as rapier 21 moves into the shed, in order to follow weft yarn 61 in shed S1, up to the configuration of FIG. 13 where rapier 21 stops in a position along axis Y1 which depends on the desired length L61 for weft yarn 61. In this configuration clamp 31 and scissors 30 are successively actuated to hold weft yarn 61 and to cut it. Thus, this method differs from the first one in that closing of the shed S1 around the weft yarn 61 occurs before holding and cutting this weft yarn. Closure of the shed also occurs after cutting of weft yarn 61, as in the first method of the invention described here above. This is not compulsory In the third embodiment of the invention represented on FIGS. 14 to 17, two rapiers 21 and 22 are used to draw two weft yarns 61 and 62 into two superposed sheds S1 and S2. This method can be implemented on a double shed loom, for at least two successive picks, and in practice for a relatively large number of picks.

Figure 15:
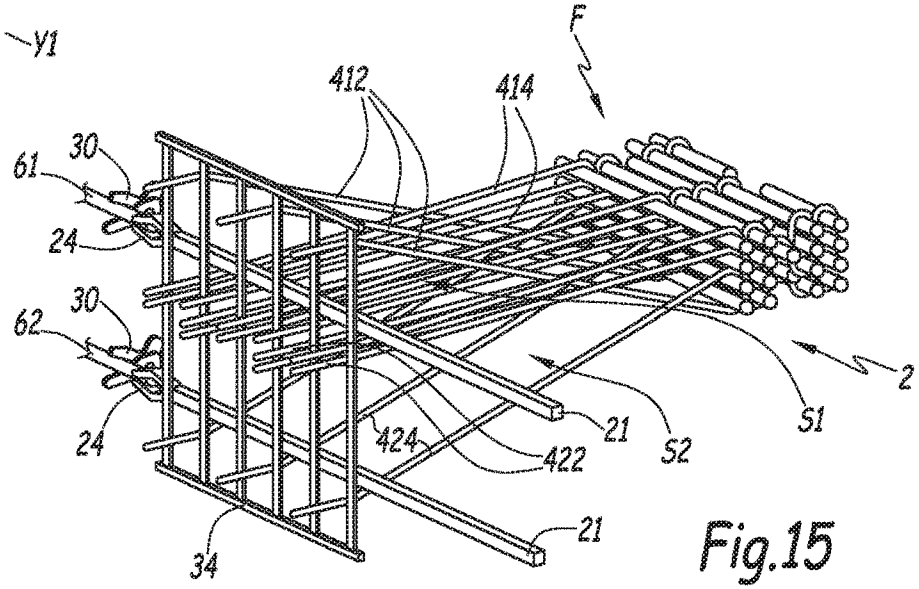
FIGS. 14 to 17 are partial perspective views of another weaving loom according to the invention during successive steps of a method according to the invention.
Figure 14:
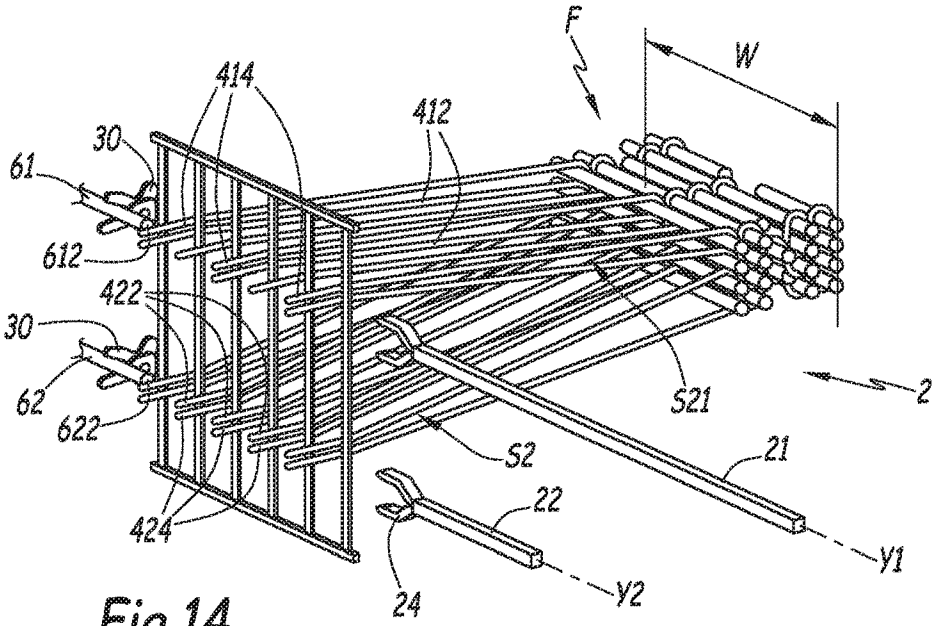
Figure 16:
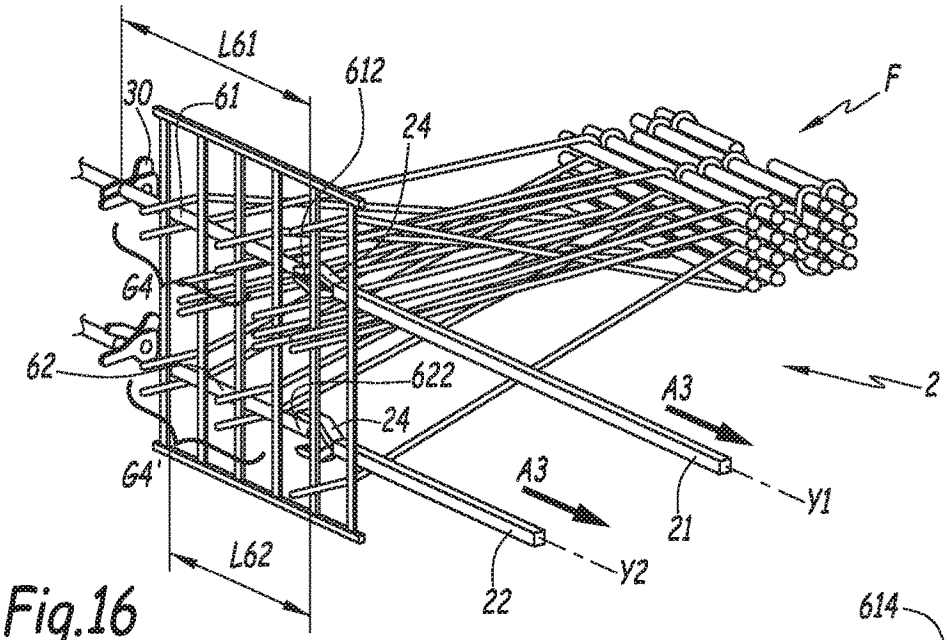

FIG. 14 of this method corresponds to FIG. 2 of the first method. The two weft yarns are held by the weft delivery unit 28. In the configuration of FIG. 15, the clamps 24 of the rapiers 21 and 22 respectively pick up the weft yarns 61 and 62 by their ends 612 and 622. Then rapiers 21 and 22 draw the weft yarns 61 and 62 within the sheds S1 and S2 as shown by arrows A3 on FIG. 16. FIG. 16 shows that the desired length L62 for weft yarn 62 is shorter than the desired length L61 for weft yarn 61. Thus, weft yarn 62 has been cut before the position represented on FIG. 16, whereas weft yarn 61 is cut in this position. In this position, clamp 24 of rapier 22 releases end 622 of weft yarn 62 whereas clamp 24 of rapier 21 is still holding end 612 of weft yarn 61.

As shown on FIG. 16, a first group G4 of warp yarns is brought to a semi-closed position around weft yarn 61 whereas a second group G4' is of warp yarns is brought to a semi-closed position around weft yarn 62. In other words, sheds S1 and S2 are closed around weft yarns 61 and 62 at the level of warp yarn groups G4 and G4'. These positions are also held in the configuration of FIG. 17.

Figure 17:
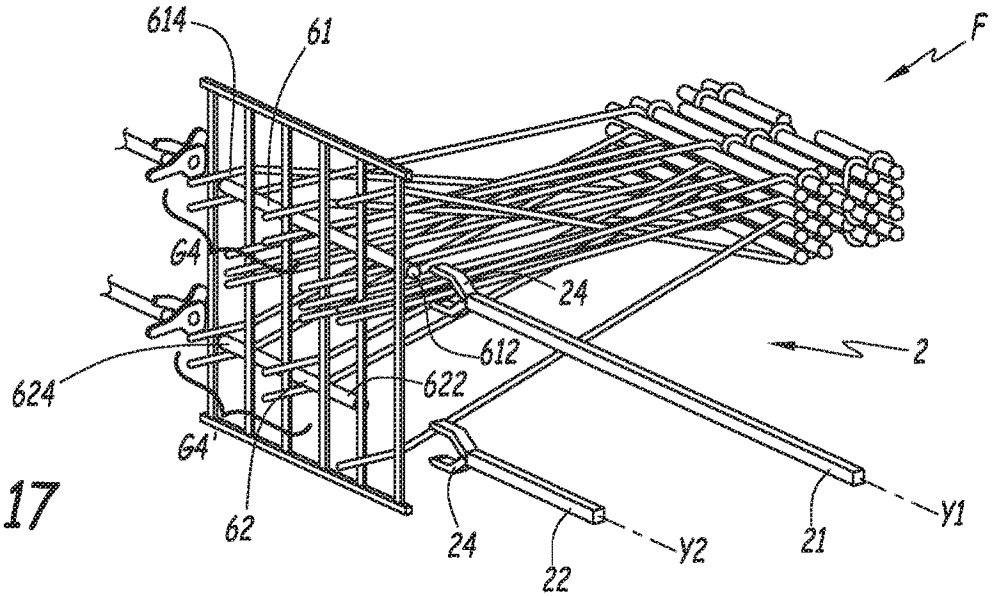

As shown on FIG. 17, weft yarn 61 is drawn, along weft axis Y1 on a longer distance than the distance on which weft yarn 62 is drawn along axis Y2 so that, even if their second respective ends 614 and 624 are roughly aligned vertically, the first ends 612 and 622 of weft yarns 61 and 62 are offset along the direction of the width of fabric F.

The method of FIGS. 14 to 17 allows building a fabric F with different layers of superposed weft yarns by simultaneously inserting superposed weft yarns 61 and 62 into superposed sheds S1 and S2 and by varying the shed distribution like the generated profiles of the warp yarns between successive picks.

According to an optional approach also shown on FIGS. 14 to 17, this method allows stacking weft yarns one above the other, within fabric F. In this method, two weft yarns 61 and 62 are simultaneously inserted into two sheds S1 and S2 so that a stack of four weft yarns can be built within two successive picks. These stacked weft yarns are bound by warp yarns which are used here as binding yarns. As shown on FIGS. 14 to 17, a stack of weft yarns may be made of less than four yarns, e.g. two yarns.

Thus, depending on the desired pattern for fabric F, one can adjust, for each pick the location of a stack of weft yarns along the width of the fabric, as defined by position angle $\alpha$. One can also individually adjust the length L61 and L62 of the superposed weft yarns and, possibly, the number of weft yarns in a stack.

It is also possible to use stacks of weft yarns in the first two methods of the invention.

In any case, the location of the superposed weft yarns along weft axis Y1, Y2 and their respective length can be adjusted for each pick.

The cross-section of the weft yarn is circular on the figures. However, it can be flat or have any other desired cross-section. If this cross-section is not circular, distance d4 is defined with respect to the vertical maximum dimension of this cross-section in order to define the semi-closed position of warp yarns of group 44. This value d4 is also used to determining deviation set parameters dA2 or dA3 for profiles Q2+, Q2−, Q3+ or Q3−.

The preferred embodiment mentioned here-above uses a Jacquard electric shedding mechanism 12. However, the invention can also be used with other kinds of shedding mechanisms, in particular with a shedding mechanism which controls some predetermined groups of warp yarns together, via heddle frames.

The invention is described here-above when the weft insertion means is formed by one or several taker rapier. However, the invention can also be used with other kinds of insertion means, in particular on air jet or water jet looms.

In a preferred embodiment, the clamp 24 of each rapier head is powered from a source of energy via an electric wire. Alternatively, other actuator types can be used at the level of clamps 24, in particular with embedded energy accumulators. This clamp can be operated via wireless technology.

Moreover, the location of each weft yarn within fabric F can be fixed along traverse axis Y by gluing or thermosetting this weft yarn with adjacent warp yarns.

The invention is described here-above in case it uses one or two rapiers and one or two sheds. Alternatively, more than two rapiers and more than two sheds can be used.

Even if generic profiles G1+, G1−, G2+, G2−, G3+ and G3− are clearly adapted to the present invention, other profile types can be used for yarn groups G4 and G4'. Furthermore, the height scale and the time scale, or angular scale, used in these profiles can be adapted to the cinematics desired for the loom 2.

Alternatively, the deviation of an actual profile Q1+, Q1−, Q2+, . . . with respect to the corresponding generic profile G1+, G1−, G2+, . . . is defined by a single parameter or by at least three parameters.

The embodiments and alternative embodiments mentioned here-above can be combined in order to generate new embodiments of the invention.

The invention claimed is:

1. A weaving loom for weaving a near-net shape fabric, comprising:
- a warp delivery unit;
- a shed formed by heddles for moving warp yarns;
- a shedding mechanism for moving each heddle of the heddles vertically along a corresponding vertical path;
- a weft insertion means for inserting a weft yarn in the shed and for releasing the weft yarn at a given position along a weft axis; and
- a weft delivery means for delivering the weft yarn to the weft insertion means;
- wherein the weft insertion means is provided with a programmable clamping means for grasping a first end of the weft yarn to draw the weft yarn into the shed and to release the weft yarn at any predetermined position along the weft axis; and
- wherein the shedding mechanism includes actuators programmable to semi-close the shed around the inserted weft yarn at any predetermined position along the weft axis.

2. The weaving loom according to claim 1, further comprising a programmable cutting means for cutting the weft yarn at a length defined for each pick.

3. The weaving loom according to claim 1, wherein, when the shed is semi-closed around the weft yarn, each actuator of the actuators controls a position of a corresponding heddle of the heddles along the corresponding vertical path and a corresponding shed opening angle.

4. The weaving loom according to claim 1, wherein the shed is semi-closed around the weft yarn gradually along the weft axis, depending on the given position of the weft yarn along the weft axis.

5. The weaving loom according to claim 1, wherein the weft yarn is cut at a predetermined length after the programmable clamping means grasps the first end and before the weft insertion means inserts the weft yarn in the shed.

6. The weaving loom according to claim 1, wherein for each pick, a position of each said heddle along the corresponding vertical path is controlled on the basis of a predetermined profile selected between at least two of the following profiles:

a first profile based on a first generic profile, which goes gradually from a fully closed position to a fully open position and then back to the fully closed position;

a second profile based on a second generic profile, which goes gradually from the fully closed position to an open position, then to a semi-closed position, and finally back to the fully closed position;

a third profile based on a third generic profile, which goes gradually from the fully closed position to the open position, then to the semi-closed position, then to the open position and finally back to the fully closed position.

7. The weaving loom according to claim 6, wherein each predetermined profile is defined by at least one parameter representative of its deviation from a corresponding generic profile.

8. The weaving loom according to claim 1, wherein at least two weft yarns, having a cumulated total length smaller than a fabric width, are inserted within the shed during successive picks and are released at different locations along the weft axis, with no overlapping lengths along the at least two weft yarns between the different locations.

9. The weaving loom according to claim 1, wherein the shedding mechanism is a Jacquard shedding mechanism including electric actuators.

10. The weaving loom according to claim 1, wherein the weaving loom is configured to weave a fabric including different layers of superposed weft yarns, these different layers obtained either by simultaneously inserting superposed weft yarns into superposed sheds or by successively inserting weft yarns, into successive sheds and by interlacing these groups of weft yarns via binding warp yarns to form stacks of weft yarns, wherein the weaving loom is set so that a location, a length of the superposed weft yarns, and a number of weft yarns in a stack are adjusted for each pick.

11. A near-net shape fabric including warp yarns and weft yarns, wherein said near-net shape fabric is made on the weaving loom of claim 10, and the near-net shape fabric includes at least one weft yarn with a total length smaller than a width of the fabric and different layers of superposed weft yarns with different lengths.

* * * * *